US007777593B2

(12) United States Patent
Weitzenberger

(10) Patent No.: US 7,777,593 B2
(45) Date of Patent: Aug. 17, 2010

(54) HIGH FREQUENCY FILTER WITH BLOCKING CIRCUIT COUPLING

(75) Inventor: Wilhelm Weitzenberger, Simbach am Inn (DE)

(73) Assignee: Kathrein-Werke KG, Rosenheim (DE)

( * ) Notice: Subject to any disclaimer, the term of this patent is extended or adjusted under 35 U.S.C. 154(b) by 375 days.

(21) Appl. No.: 11/645,798

(22) Filed: Dec. 27, 2006

(65) Prior Publication Data

US 2008/0157899 A1 Jul. 3, 2008

(51) Int. Cl.
*H01P 7/04* (2006.01)
*H01P 1/202* (2006.01)
*H01P 3/06* (2006.01)

(52) U.S. Cl. ..... 333/134; 333/203; 333/207; 333/212; 333/223; 333/230

(58) Field of Classification Search ..... 333/203, 333/206, 207, 212, 222, 223, 227, 230, 134, 333/202

See application file for complete search history.

(56) References Cited

U.S. PATENT DOCUMENTS

| | | | | |
|---|---|---|---|---|
| 3,571,768 | A * | 3/1971 | Gundry | 333/230 |
| 3,736,536 | A | 5/1973 | Wenzel | |
| 4,216,448 | A | 8/1980 | Kasuga et al. | |
| 5,389,903 | A | 2/1995 | Piirainen | |
| 5,418,509 | A * | 5/1995 | Piirainen | 333/203 |
| 5,528,204 | A | 6/1996 | Hoang et al. | |
| 5,777,534 | A * | 7/1998 | Harrison | 333/202 |
| 5,812,036 | A * | 9/1998 | Estrada | 333/202 |
| 6,320,482 | B1 * | 11/2001 | Ala-Kojola et al. | 333/206 |
| 6,320,483 | B1 * | 11/2001 | Raty et al. | 333/207 |
| 6,366,184 | B1 * | 4/2002 | Ohtonen | 333/202 |

FOREIGN PATENT DOCUMENTS

| | | | |
|---|---|---|---|
| JP | 09199906 | A | 7/1997 |
| WO | 8910533 | | 2/1989 |
| WO | 99/30383 | | 6/1999 |
| WO | WO02054527 | A2 | 7/2002 |
| WO | 2004/100305 | | 11/2004 |
| WO | WO2004100305 | A1 | 11/2004 |
| WO | 2006/053607 | | 5/2006 |

OTHER PUBLICATIONS

International Search Report issued in corresponding PCT application PCT/EP2007/010634 (Feb. 28, 2008).

Thomas, J. Brian, "Cross-Coupling in Coaxial Cavity Filters—A Tutorial Overview," IEEE Transactions on Microwave Theory and Techniques, vol. 51, No. 4, Waco Texas, USA (Apr. 2003).

Hunter, Ian, IEE Electromagnetic Waves Series 48, "Theory and Design of Microwave Filters," 5.8 Narrowband Coaxial Resonator Filters, p. 197, London, England (2001).

Thomas, *Cross-Coupling in Coaxial Cavity Filters—A Tutorial Overview*, IEEE Transactions on Microwave Theory and Techniques, vol. 51, No. 4, Apr. 2003, pp. 1368-1376.

* cited by examiner

*Primary Examiner*—Robert Pascal
*Assistant Examiner*—Kimberly E Glenn
(74) *Attorney, Agent, or Firm*—Nixon & Vanderhye PC

(57) ABSTRACT

An improved high frequency filter displays the following features: the high frequency filter displays transmission behavior with a coupling impedance resonance having at least one blocking point at a frequency, the blocking point at the frequency being adjustable by presetting and/or preselecting a defined capacitive and inductive coupling between two coaxial resonators, one immediately following the other on a signal path.

20 Claims, 7 Drawing Sheets

HIGH FREQUENCY FILTER WITH BLOCKING CIRCUIT COUPLING

The invention relates to a high frequency filter with blocking circuit coupling according to the preamble of Claim 1.

High frequency filters are used in a broad range of applications.

For example, in digital mobile communications technology, the communication of the mobile subscriber with the base station is conducted via transmitting/receiving antennas provided in the base station. In this case, it is desirable to use only one common antenna for the transmission and reception signals.

Transmission and reception signals utilize in this regard differing frequency ranges. The antenna used has to be suitable for transmitting and receiving in both frequency ranges. Separating the transmission and reception signals requires a suitable frequency filtering process which ensures, on the one hand, that the transmission signals from the transmitter are forwarded only to the antenna (and not toward the receiver) and, on the other hand, that the reception signals from the antenna are forwarded only to the receiver.

For this purpose, use may be made of a pair of high frequency filters which both pass a specific frequency band, i.e. the frequency band desired in each case (band-pass filters). However, use may also be made of a pair of high frequency filters which block a specific frequency band, i.e. the undesired frequency band in each case. These are known as band-stop filters. Also possible is the use of a pair of high frequency filters consisting of a first filter, which passes frequencies below a frequency between the transmission and reception bands and blocks the ranges thereabove (low-pass filter), and a second filter, which blocks frequencies below this frequency between the transmission and reception bands and passes the frequencies thereabove. This is then what is known as a high-pass filter. Further combinations of the aforementioned types of filters can be used.

The transmission/reception bands are in this case generally split up within the base station using duplex filters which have the aforementioned task of connecting the transmission/reception path to the common antenna with as little feedback as possible. The duplex filter consists in this regard of two interconnected band-passes, i.e. what is known as the transmission band-pass (TX-band-pass) and the reception band-pass (RX-band-pass), separate terminals being provided for the reception branch, the transmission branch and the common connected antenna.

The band-passes used within the duplex filter therefore have, on the one hand, to display the selection necessary for interconnecting the transmission and reception band-passes (TX/RX) (i.e. the necessary blocking attenuation) and should, on the other hand, in their respective pass range attenuate the useful signals as little as possible.

The band-pass structures used in duplex filters are constructed in the common mobile communications frequency ranges (for example, GSM/UMTS) predominantly as coaxial resonators.

The construction and mode of operation of coaxial resonators are known from the prior art, for example Ian Hunter, "Theory and Design of Microwave Filters", IEE Electromagnetic Waves Series, No. 48, 1. Microwave filters, page 197.

Filter theory describes band-passes (what are known as Cauer band-passes) which display in the blocking range transmission zero points (what are known as blocking poles). This type of filter is very frequently produced, in conjunction with coaxial resonators, by what is known as cross-coupling. In this case, non-adjacent resonators (i.e. resonators not immediately following one another in the course of the signal) are capacitively or inductively cross-coupled within a band-pass structure in such a way that amplitude obliterations (transmission zero points or blocking points), conditioned by signal splitting with subsequent phase-shifted combining, are produced in the transmission characteristic. A cross-coupling method of this type is described, for example, in IEEE Transactions on microwave theory and techniques, Vol. 51, No. 4, April 2003, "Cross-Coupling in Coaxial Cavity Filters—A Tutorial Overview", J. Brian Thomas, pages 1368 to 1376.

However, what is known as cross-coupling has the drawback that the necessary cross-coupling requires resonators which are not adjacent to one another, i.e. are not arranged one following the other. However, this requires filter topologies which mechanically facilitate this cross-coupling.

Owing to the limited number of suitable pairs of resonators for cross-coupling, only a limited number of blocking poles can therefore be generated.

A generic high frequency filter with blocking circuit coupling, in particular in the form of a duplex filter, is, in principle, to be taken as known from WO 2004/100305 A1. This is a high frequency filter comprising a plurality of resonators arranged between three terminals, i.e. between a terminal for a transmission branch, a terminal for the reception branch and a terminal for the common antenna.

According to the generic prior art, provision is made, for improving a duplex filter of this type, for it to comprise at least one pair of resonators markedly cross-coupled to each other, the resonators markedly cross-coupled to each other oscillating, when coupled, at two differing coupling resonance frequencies which differ from the resonance frequency which the two markedly cross-coupled resonators display, viewed in isolation, in the respective frequency range between the transmission and reception bands or to which the resonators are adapted.

The object of the present invention is to provide an improved high frequency filter having an improved passing and/or blocking effect for presettable frequencies or frequency ranges, wherein the filter topology should be as unrestricted as possible.

The invention is achieved in accordance with the features specified in Claim 1. Advantageous embodiments of the invention are recited in the sub-claims.

According to the invention, the improvement over the prior art is achieved in that there is allocated to the high frequency filter, which comprises electromagnetically coupled coaxial resonators, with respect to at least one selected coaxial resonator pair, both coaxial resonators of which are located immediately adjacent to each other in the transmission path, a specially preselectable and/or preadjustable coupling impedance which is configured in such a way that there is produced, based on the combination of capacitive and inductive coupling, a coupling impedance resonance at a defined blocking frequency. As this type of cross-coupling generates a blocking point in the transmission behavior of the high frequency filter, it will also be referred to hereinafter as the blocking circuit coupling.

In other words, this blocking circuit coupling, i.e. the blocking frequency, may, within the scope of the invention, be laid in such a way that it is positioned, on the one hand, outside the pass range of the HF filter and, on the other hand, within the blocking range of an HF filter.

Preferably, the blocking frequency may be preset mainly by varying and/or adjusting and/or preselecting two variables substantially influencing or determining the blocking frequency. It is crucial in this regard that, in addition to a defined inductive resonator coupling, a defined capacitive coupling takes place. The defined inductive coupling can in this case be adjusted, for example, via the distance between the resonators to be cross-coupled. The required capacitive coupling, on the other hand, can be produced, for example, by elongate extension on the upper side of the resonators to be cross-coupled. Even if the variation of each of the two above-mentioned variables also exerts a certain influence on the respective other variable, presetting both the inductive and the capacitive coupling nevertheless allows the desired cross-coupling of adjacent resonators to be adjusted in varied form so that the desired attenuation is outside the pass range of an HF filter and within a blocking range of an HF filter.

Within the scope of the invention, the following fundamental advantages may therefore be achieved:

Firstly, adjacent resonators can now be cross-coupled in such a way as to generate blocking points. This has the fundamental advantage that, in the production of high frequency filters, no such restrictions are placed on the configuration of filter topologies, i.e. with regard to the arrangement of the coaxial resonators, as in the prior art. In the prior art there was the grave drawback that in the case of what is known as cross-coupling (i.e. the production thereof), the necessary cross-coupling could not be carried out between adjacent resonators. This then necessitated highly specific filter topologies in order to facilitate cross-coupling between two non-adjacent resonators.

As cross-coupling of two adjacent resonators is possible within the scope of the invention, this in principle also provides the option of cross-coupling any number of adjacent pairs of resonators. Within the scope of the invention, for n-resonators, even n−1 blocking points can be generated, i.e. many more than in the case of conventional cross-coupling.

Within the scope of the invention, for corresponding adjustment of the capacitive coupling, the distance between two internal conductors can be reduced in that said conductors are provided on their upper side with radial extensions. This can also be utilized to reduce the overall height of the filter.

The invention will be described hereinafter in greater detail with reference to the drawings, in which, specifically:

Figure 1:
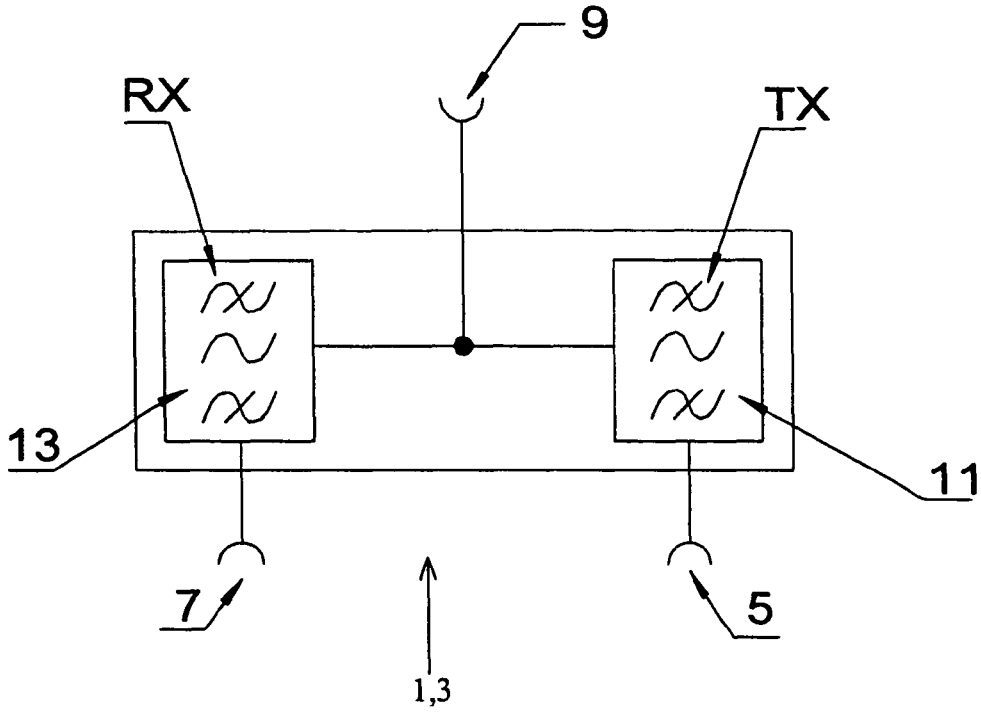
FIG. 1 is a schematic basic view of the schematic construction of a high frequency filter in the case of a duplex filter.

FIG. 1 is a schematic view of a high frequency filter in the form of a duplex filter 3, the HF filter 1 comprising three terminals 5, 7 and 9, i.e. a terminal TX, RX and a terminal for the antenna port AP, so transmission signals originating from the transmission terminal 5 via a first signal path can be supplied to the antenna port AP (and from there to the common antenna) and, conversely, the signals received by the antenna can be supplied to the reception terminal 7 via the antenna port AP (terminal 9).

The duplex filter 3 comprises for this purpose in the two signal paths a corresponding band-pass filter 11 and 13 respectively, which display the necessary selection (i.e. blocking attenuation) to prevent any signals from passing from the transmission terminal into the reception branch. On the other hand, the pass ranges for the useful signals should be attenuated as little as possible.

Figure 2:
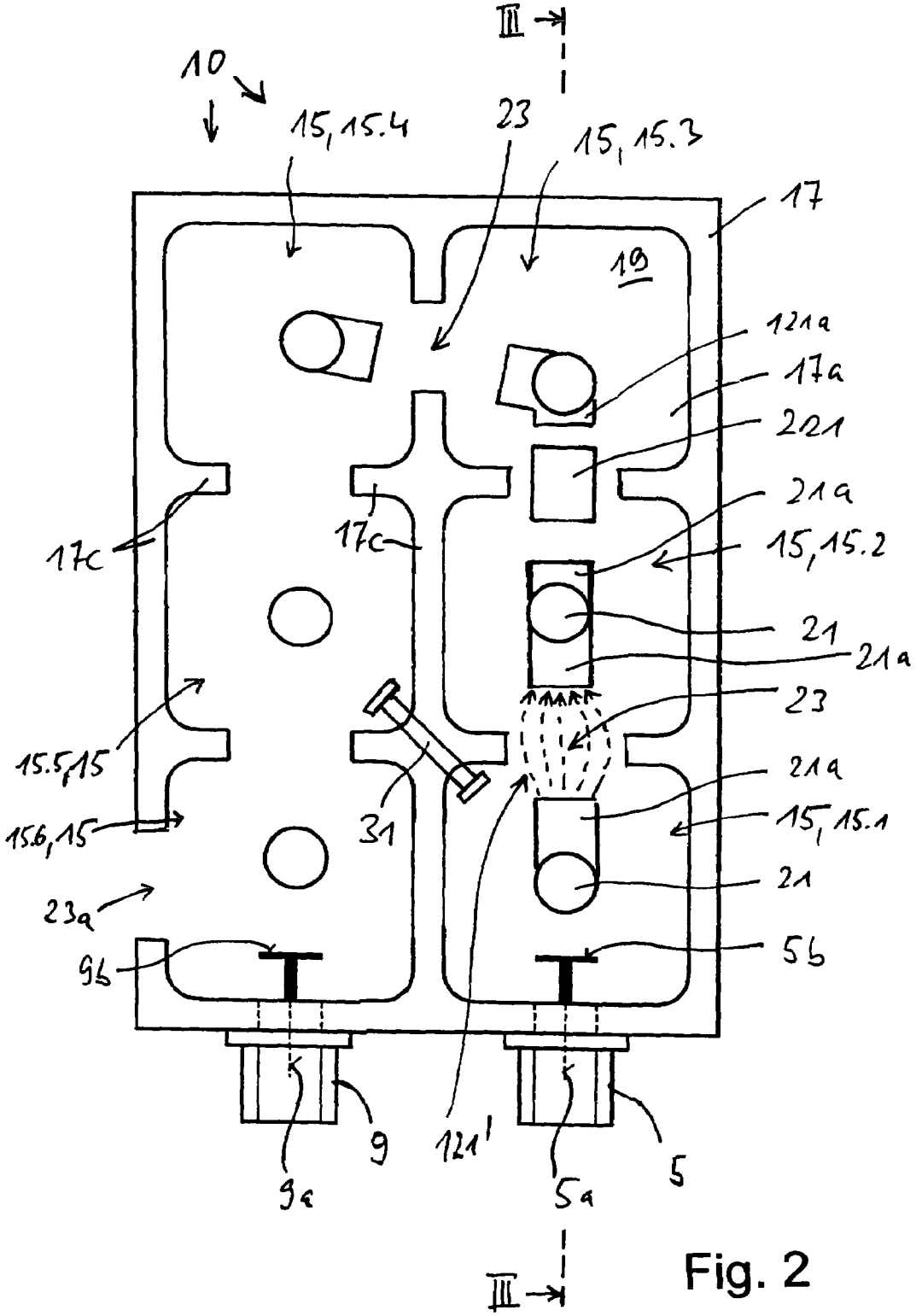
FIG. 2 is a schematic plan view of a high frequency filter with a signal path.

In this regard, FIG. 2 is, by way of example, a schematic plan view (omitting an upper cover) of a high frequency filter 1 with a signal path 10 extending, for example, from a terminal 5 to a terminal 9, i.e. from a transmission terminal to an antenna port terminal (i.e. only the one branch of a duplex filter) and thus comprises six coaxial resonators 15.

The coaxial resonators 15 are arranged in this case in a conductive housing 17 comprising a plurality of resonator chambers 19 where there extends in the illustrated embodiment, centrally or substantially in the central region perpendicular to the housing base 17*a*, a respective conductive internal conductor 21—as is apparent from the view according to FIG. 3—which ends at a suitable distance below an electrically conductive housing lid 17*b* which can be placed onto the housing 17.

Each coaxial resonator 15 thus comprises a peripheral housing wall 17*c*, coupling openings 23, known as apertures, being provided in the respective housing wall 17*c* along the signal path, thus forming windows through which the electromagnetic waves are able to spread.

Provided in a known manner at the coaxial terminals 5 and 9 are internal conductors 5*a* and 9*a* respectively, which protrude into the associated resonator chambers 19 and end, for example, in a conductive planar element 5*b* or 9*b*, via which, with the associated internal conductor in the respective coaxial resonators 15, as a result of the capacitance thus formed, the coupling-in of the electrical field at the terminal 5 and the corresponding decoupling of the electrical field at the terminal 9 ensue (wherein for example, conversely, the signal received by the antenna is coupled into the associated resonator on the second signal path via the conductive planar element 9*b* and leads to a terminal 7 (not shown in detail in FIG. 2) via a second signal path). FIG. 3 therefore shows merely a schematic cross section, by way of example, through a portion for the band-pass filter 11 provided for the transmission branch, wherein the signal path for the second reception branch, not shown FIG. 2, of the duplex filter could be connected via the aperture gate 23*a* located on the left-hand side in FIG. 3.

With respect to the described signal path from the terminal 5 to the terminal 9, six coaxial resonators 15.1 to 15.6 are thus cross-coupled.

Figure 4:
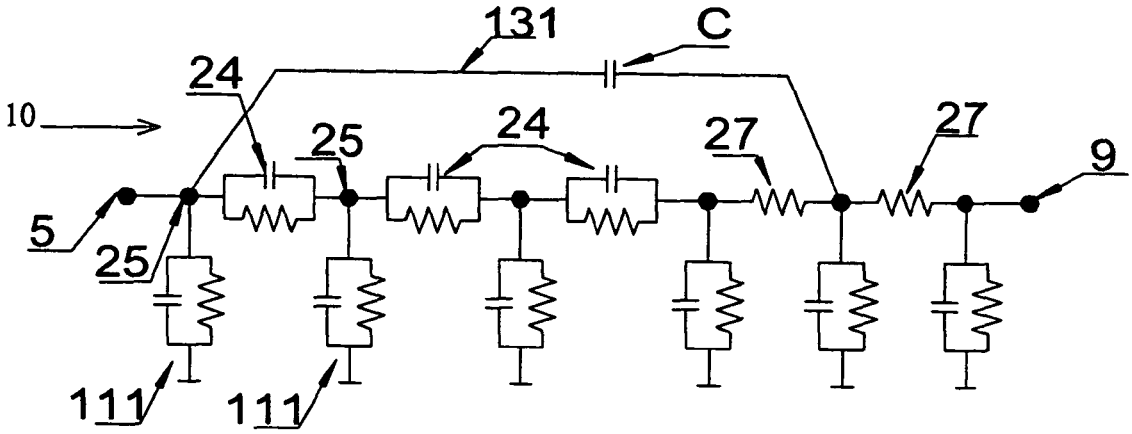
FIG. 4 is an equivalent circuit diagram with regard to the embodiment according to FIGS. 2 and 3.

FIG. 4 shows the corresponding equivalent circuit diagram, with the signal path 10 from the terminal 5 to the terminal 9, the six resonators 11 being illustrated as parallel resonant circuits 111, of which one output is grounded and the opposing output is connected to the signal path 10 in the corresponding sequence. The parallel resonant circuits 24 are in this case characterized in a known manner by a capacitor and an inductor. The stretches between the terminal points 25 of the individual parallel resonant circuits 24 can also be described by inductors 27, provided that these are conventional couplings between coaxial resonators, i.e. not the cross-coupling according to the invention to be described hereinafter. Insofar as a coupling according to the invention is effective, the connection between two adjacent parallel resonant circuits cross-coupled in accordance with the invention can be described not by an inductive coupling but rather by a blocking circuit coupling in the form of a parallel resonant circuit comprising a capacitor and an inductor, as shown in FIG. 4. Between the first and fifth coaxial resonator 15.1 and 15.5 respectively, there is additionally formed, as in the prior art, a capacitive cross-coupling using a capacitor C (see FIG. 2).

This equivalent circuit diagram according to FIG. 4 shows that a cross-coupling according to the invention is formed between the first and the second coaxial resonators 15.1 and 15.2, between the second and third coaxial resonators 15.2 and 15.3, and the third and fourth coaxial resonators 15.3 and 15.4. In addition, also shown in the illustrated embodiment is a conventional cross-coupling according to the prior art between the first and the fifth coaxial resonators 15.1 and 15.5 which will also be considered hereinafter.

Figure 3:
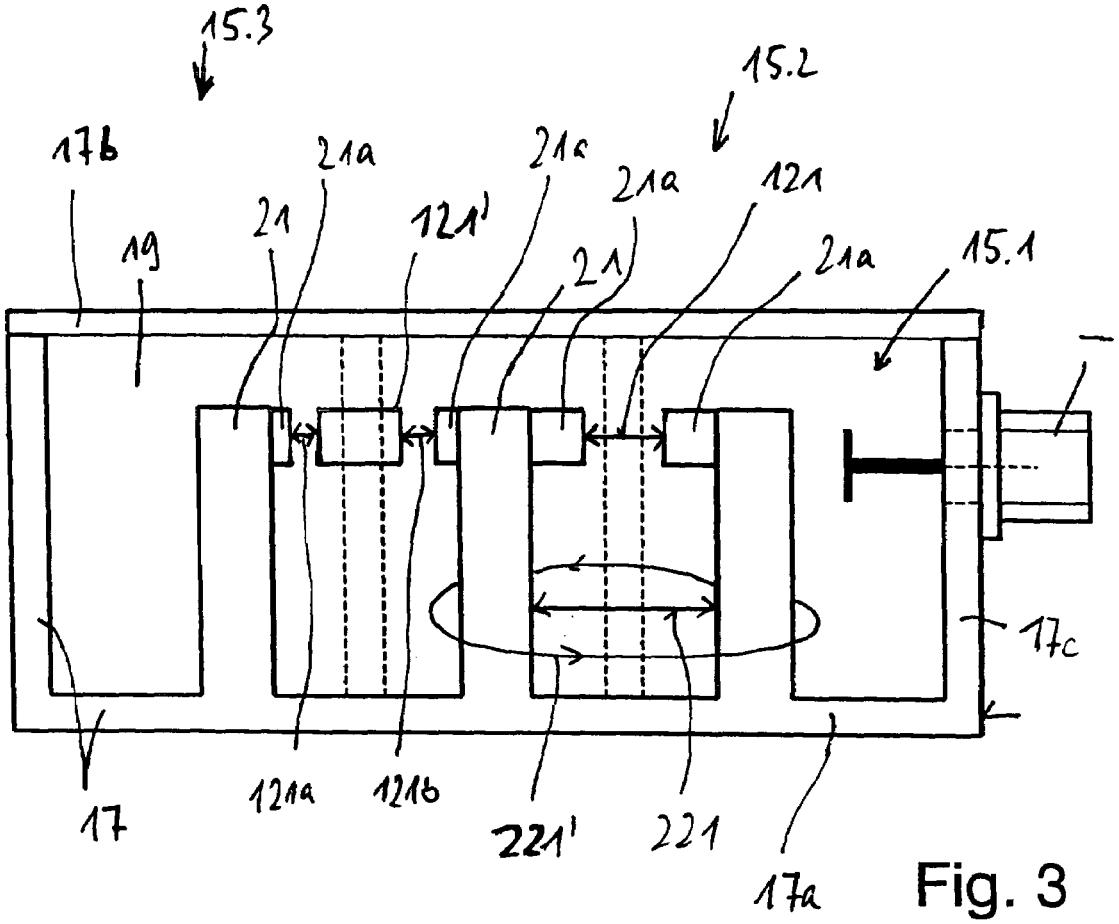
FIG. 3 is an axial section along the line III-III in FIG. 2.

The side view according to FIG. 3 shows that for cross-coupling the immediately adjacent resonators, i.e. the resonators immediately following one another in the course of the signal, 15.1 and 15.2, the associated internal conductors, located in the connection direction thereof, are each provided with mutually facing, radially protruding internal conductor portions 21*a*. As a result, the clearance 121 between the two internal conductors 21 is adjusted in such a way as to produce a desired capacitive coupling.

This capacitive coupling is illustrated, by way of example, between internal conductor portions 21*a* on the two internal conductors 21 of the two first coaxial resonators 15.1 and 15.2 in FIG. 3, by correspondingly plotted E-field vectors 121' (FIG. 2).

In addition, FIG. 3 shows an inductive cross-coupling through an H-field line 121' for the two first resonators 15.1 and 15.2, too. Presetting the distance 221 between the two internal conductors 21 (without taking into account the aforementioned radially protruding internal conductor portions 21*a*) ultimately allows the inductive cross-coupling 221' to be preselected and/or adjusted accordingly.

However, the inductive cross-coupling can also be pre-adjusted or preselected differently using other alternative or supplementary, i.e. additional, measures. Very generally, it will be noted that the coupling capacitances and coupling inductances necessary for adjusting the blocking circuit coupling can be adjusted using known coupling adjustment variations. The height and/or width of the coupling apertures (i.e. the through-openings between two adjacent coaxial resonators), for example, can thus be adjusted differently so as to vary the degree of coupling. Coupling pins, coupling loops or coupling webs can also be provided between the resonators. The coupling webs would, for example, extend at a partial height between two internal conductors, i.e. also extend parallel to the internal conductors (preferably perpendicularly to the wall of the base) and thus be electrically connected to the base of the coupling resonators. The coupling loops can be electrically and mechanically connected in the manner of an inverted U-bolt between two internal conductors on the base. It is also possible for a coupling loop to be positioned in the vertical orientation (i.e. so as to be located in a vertical plane) or in a plane slightly inclined thereto, via an axis of vertical rotation relative to the base, and thus to be able to be rotated in the circumferential direction. The greater the surface area penetrated by the magnetic faces, the greater the coupling action. The aforementioned effects or parts thereof can also be used in combination in order accordingly to provide and implement the desired coupling adjustment possibilities.

Figure 6A:
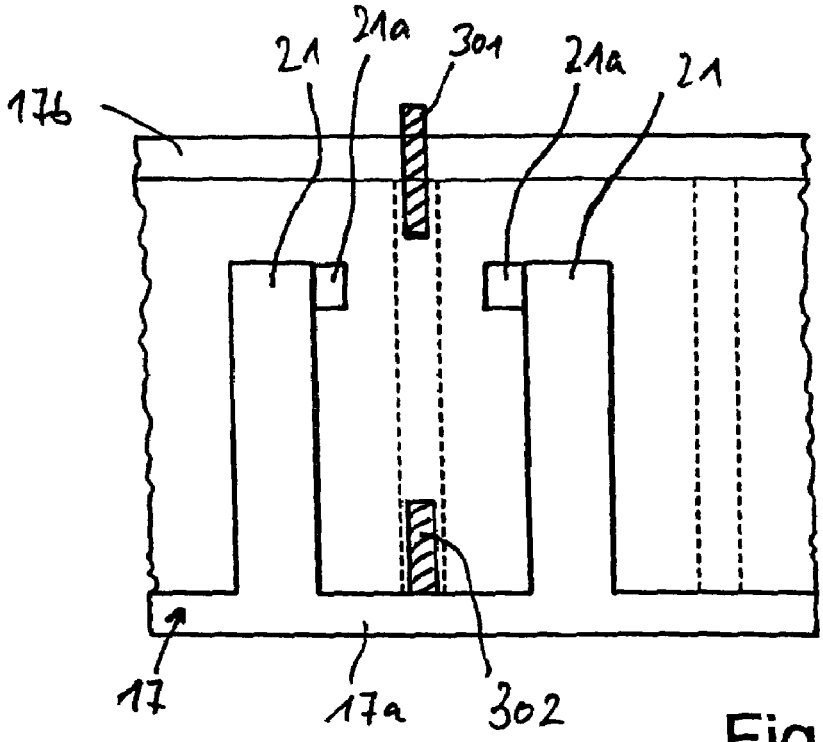
FIGS. 6*a* to 6*f* are various views at differing adjustments of a coupling capacitance or coupling inductance.
Figure 6B:
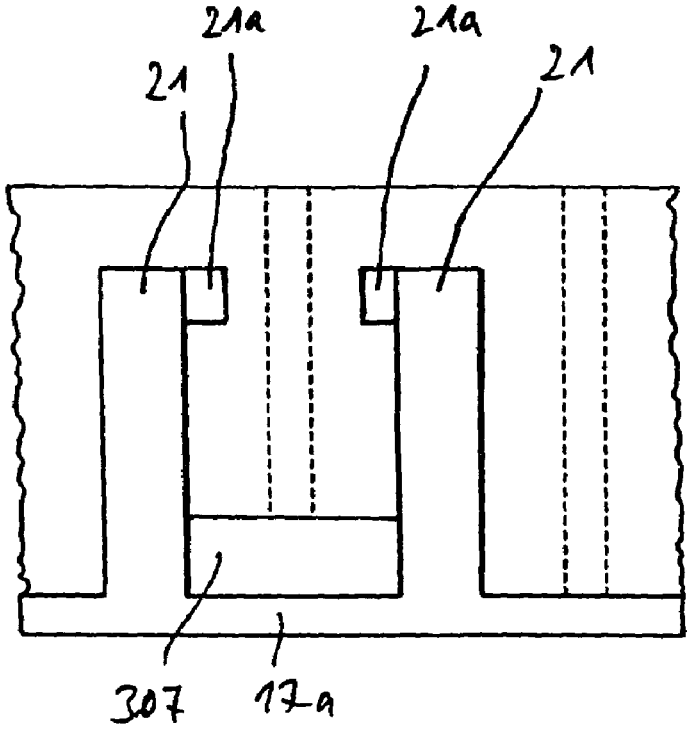

The above-mentioned adjustment possibilities are represented, by way of example, with reference to FIG. 6*a* using electrically conductive coupling pins 301, one 301 of which can, for example, be screwed in at a different position in terms of height, i.e. to a differing depth into the interior between two resonators, in the upper lid 17*b* for varying the coupling capacitance between two internal conductors 21, there also being arranged in FIG. 6*a* an electrically conductive coupling pin 302 which is screwed into the base 17*a* or positioned therein and the height and diameter of which contribute to varying the coupling inductance. FIG. 6*b* shows in plan view that there is provided along the line connecting two adjacent internal conductors 21 a web which rises from the base and extends at this location at a partial height relative to the height of the internal conductors. This is what is known as a coupling web 307. This coupling web 307 is in this case electrically connected to the base 17*a* of the housing 17 of the HF filter.

Figure 6C:
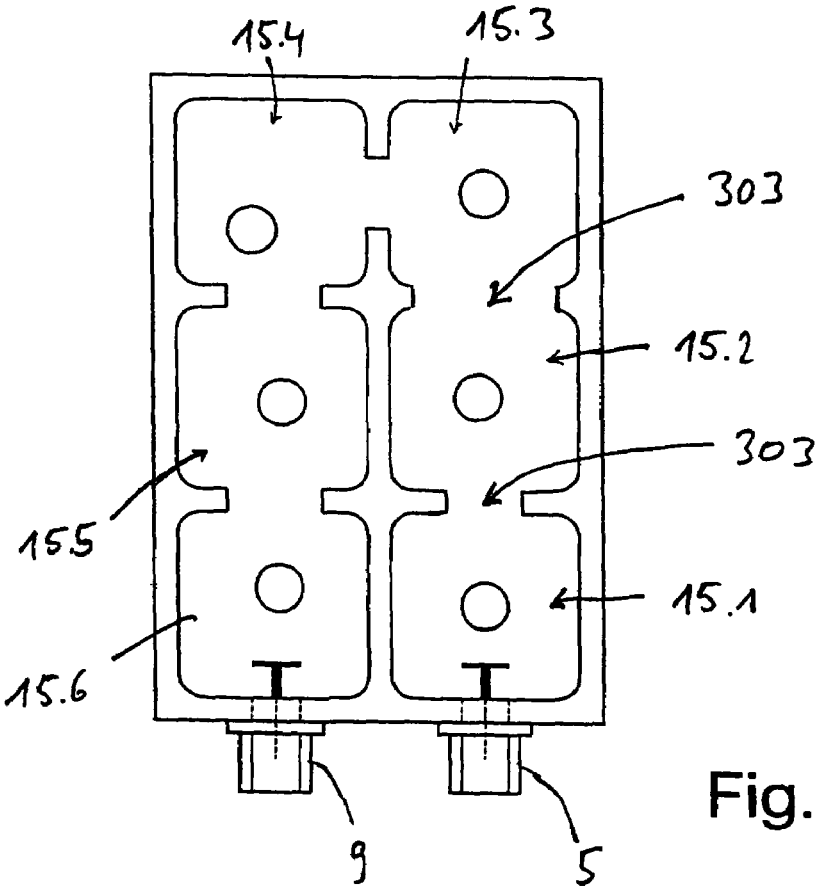
Figure 6D:
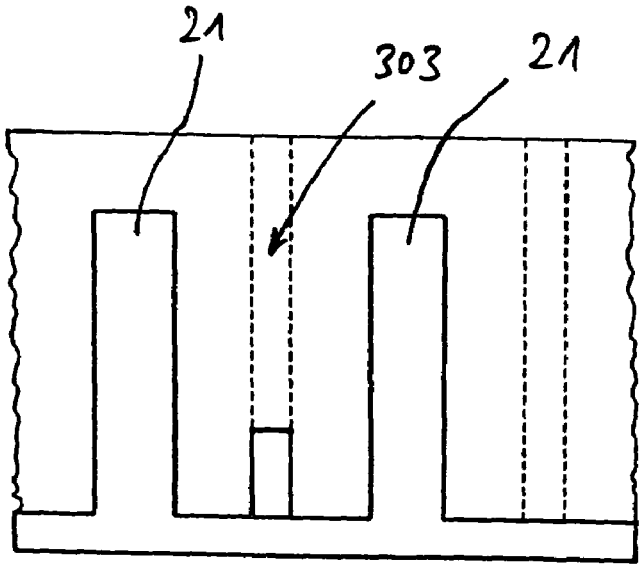

According to a further embodiment, FIG. 6*c* shows in plan view and FIG. 6*d* in vertical section that, for example, a first window opening 303 (coupling aperture) between the coaxial resonators 15.1 and 15.2 markedly decreases in size, whereas a further coupling aperture 303 between the resonators 15.2 and 15.3 markedly increases in size, so the coupling aperture has in any case a greater width parallel to the face of the base or lid.

Figure 6E:
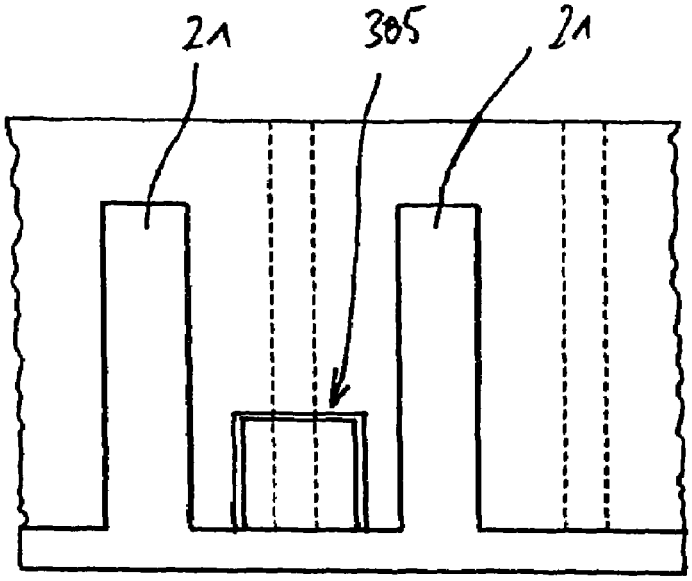
Figure 6F:
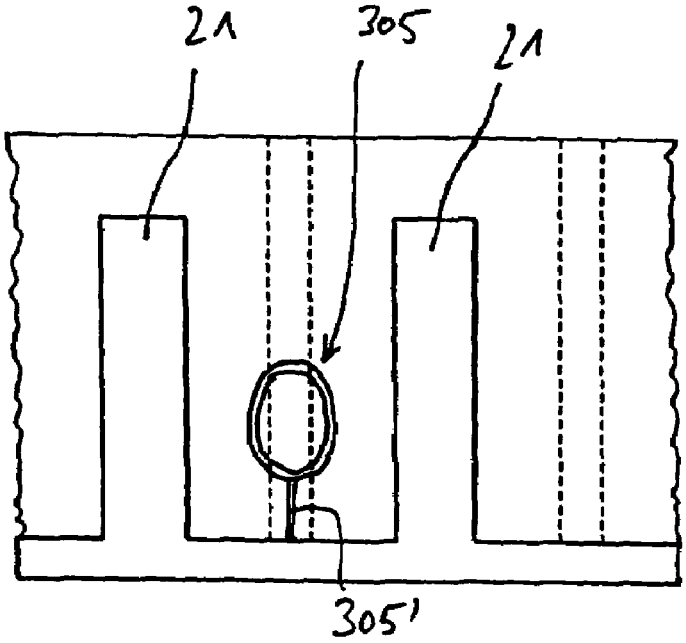

The embodiment according to FIG. 6*e* shows a coupling loop 305 for varying the coupling inductance which is positioned in the base in the manner of an inverted "U". Alternatively shown, with reference to FIG. 6*f*, is the use of a coupling loop which can be rotated about its vertical axis 305', so the magnetic field strength penetrating the loop varies, thus allowing the coupling inductance to be varied and differingly adjusted.

Very generally, it will be noted that a broad range of possibilities for generating a desired capacitive, but also a desired inductive, coupling can be combined as desired; indeed, all of the above-mentioned variations can be applied cumulatively without limitation.

The differing configuration of the coaxial resonators 15 having the aforementioned differing resonator form allows the desired blocking point at a defined blocking frequency to be generated outside the pass range of an HF filter. It is crucial in this regard that, in addition to the aforementioned defined inductive resonator coupling, a defined capacitive coupling is provided. The aforementioned inductive coupling can in this case, as stated, be adjusted by the distance 221 between the resonators to be cross-coupled (position of the internal conductor 21 of the respective resonator), whereas the capacitive coupling is adjusted via the clearance 121 between two adjacent internal conductors 21 of two adjacent resonators, the size of which can be preset by the clearance of the aforementioned elongate (radially protruding) internal conductor extensions 21.

In the embodiment shown, in addition to the cross-coupling between the first and second coaxial resonators 15.1 and 15.2, a further, directly adjoining cross-coupling is subsequently formed between the second and third coaxial resonators 15.2 and 15.3.

In contrast to the first internal conductor 21 of the first coaxial resonator 15.1, which is formed in cross section in the manner of an inverted L, the second internal conductor of the second coaxial resonator 15.2 is in this case formed in the manner of a T, i.e. with a further, opposing internal conductor extension 21*a* generally protruding parallel to the base and thus transversely or radially to the internal conductor. Even the third internal conductor 21, to be cross-coupled thereto, of the third coaxial resonator 15.3 could also be provided with a corresponding internal conductor extension 21*a*, the distance between these two adjacent internal conductor extensions 21*a* being very much greater than the distance between the first and second coaxial resonators. In the example of the cross-coupling of the second and third coaxial resonator, there is also provided for this purpose an additional bridging member 221' which is held and positioned so as to be isolated from the housing. This produces two spacer gaps 121*a* and 121*b* in which the electrical field vectors spread via air. The total distance, formed from the two individual distances 121*a* and 121*b*, produces that variable which is crucial for presetting the desired defined capacitive coupling.

Finally, the plan view according to FIG. 2 also shows that in this case, as a result of the further cross-coupling between the third and fourth coaxial resonators 15.3 and 15.4, the associated internal conductor 21 comprises not two internal conductor extensions opposing each other by 180° (such as the second internal conductor 21 of the second coaxial resonator 15.2) but rather two internal conductor extensions 21*a* facing each other at a 90° angle, i.e. in accordance with the signal path, angled by 90°, of the electromagnetic waves. As may be seen from the plan view according to FIG. 2, the two internal conductors 21 are positioned closer to the second and third resonators 15.2 and 15.3.

If the described signal path is, for example, the one signal path of a duplex filter, this may result in a band-pass filter as represented in FIG. 4, at one or more blocking frequencies $f_s$, i.e. one or more so-called blocking poles. This transmission characteristic shows that, in accordance with the number of coaxial resonators cross-coupled within the scope of the invention, the plurality of blocking poles (blocking frequencies) can be generated in such a way that these blocking frequencies are, for example, in the pass range (frequency range) of an adjacent, i.e. offset, band-pass filter.

In the embodiment shown, a further cross-coupling according to the invention may also be formed at any further desired point, i.e., for example, even between the fourth and fifth and/or the fifth and sixth coaxial resonators. In general, for n-coaxial resonators, five, i.e. n−1, coupling impedances can therefore be configured in such a way that the communication of capacitive and inductive coupling results in a coupling impedance resonance at a respectively defined frequency $f_s$, i.e. the type of cross-coupling results, in the transmission behavior of the high frequency filter, in a blocking point in the at least one frequency or the plurality of offset frequencies $f_{s1}$, $f_{s2}$, $f_{s3}$, etc. to $f_{sn}$, which blocking point can be referred to as the blocking circuit coupling.

In the illustrated embodiment there is also formed a conventional cross-coupling which can additionally be provided in the HF filter according to the invention. This conventional cross-coupling is also illustrated in the equivalent circuit diagram according to FIG. 4, i.e. via the path 131 connecting to the capacitor C provided therein.

Shown for this purpose in FIG. 2 is, for example, a cross-coupling member 31 which acts between the first and fifth coaxial resonators and is conventionally formed by an electrically conductive coupling element which protrudes into the respective cavity in the associated resonator, is "bone-shaped" in side view and the enlarged opposing closure of which at the associated internal conductor produces a capacitive cross-coupling in the respective coaxial resonator. This is also illustrated in the equivalent circuit diagram, i.e. by the capacitive cross-coupling path 131.

Within the scope of the invention, on the other hand, there is provided a blocking circuit coupling 35 comprising an inductor connected in parallel and a capacitor, as is also shown in the equivalent circuit diagram according to FIG. 4.

Figure 5:
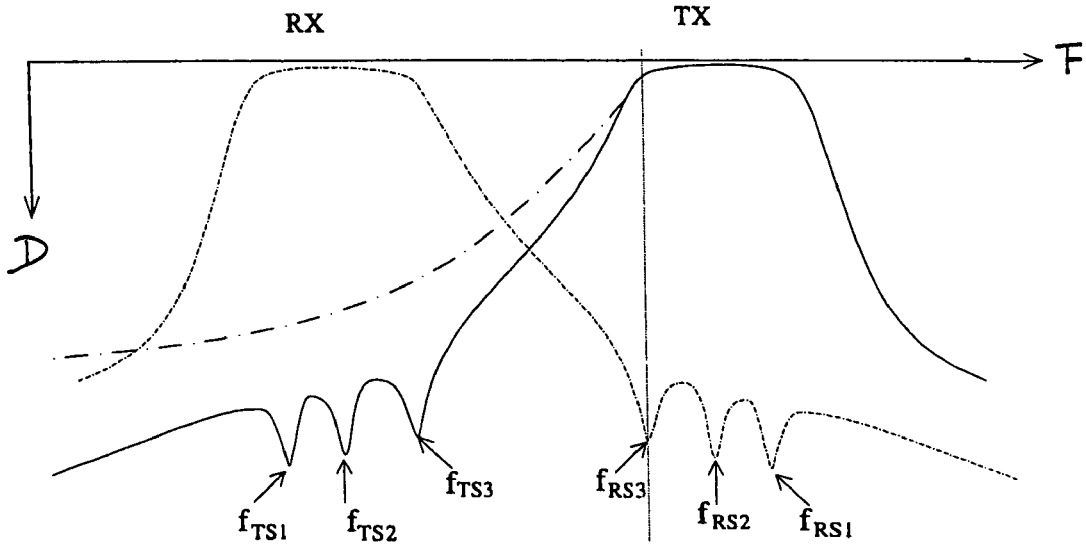
FIG. 5 is a diagram for reproducing the passing and attenuation behavior of a band-pass filter according to the invention for a duplex filter.

In conclusion, reference will also be made to FIG. 5 showing a diagram concerning the band-pass behavior of a band-pass filter 11 for a transmission branch and of a band-pass filter 13 for a reception branch (in dotted lines). This shows the plurality of blocking poles $f_{RS}$, $f_{TS}$ as a function of the number of blocking circuit couplings used. In FIG. 5, the increasing frequency F is shown on the x-axis and the attenuation D on the y-axis.

For the one band-pass filter, it is also shown how the attenuation would progress if the coupling according to the invention were not provided (dot-dash curve).

In the band-pass filter according to the invention, the at least one blocking pole or the plurality of blocking poles can be laid so as to be located, for example, in a frequency range, offset to the pass range of the respective band-pass, of an adjacent band-pass. Sufficient advantages according to the invention can, in any case, still be achieved if the one blocking pole or the plurality of blocking poles are arranged entirely, or at least in part, so as to be located outside the actual pass range of the band-pass filter, in a frequency range which is less than ±50%, in particular less than ±40%, ±30%, ±20% and especially less than ±10% from the center frequency of the respective band-pass filter.

In the case of two band-pass pass frequency ranges offset relative to each other, as are used most frequently within a duplex filter, the advantages according to the invention can be achieved to a sufficient degree even if at least one or more of the blocking poles (blocking points), viewed from a respective band-pass filter, is or are laid in such a way, by corresponding selection of suitable coupling capacitances and coupling inductances, that this at least one blocking pole is generated in a frequency range which is no further than five times the duplex separation (i.e. the center frequency separation of two adjacent band-passes) from the center frequency of the respective band-pass. The blocking poles should therefore preferably be arranged, viewed from a band-pass filter, outside the pass range of the band-pass filter in such a way that the blocking poles come to lie no further than five times, in particular no further than four times, three times, twice or one times the duplex separation (i.e. the center frequency separation of two adjacent band-passes).

Regardless of this, one or more of the blocking poles can obviously also be positioned in a frequency range of the adjacent band-pass.

In conclusion, it will be noted that it can be ascertained, on appropriate selection of the inductive or the capacitive coupling, whether the respective blocking pole is formed below a band-pass filter or above a band-pass filter (i.e. at a lower frequency or higher frequency relative to the band-pass filter). This is achieved in that the coupling capacitance and the coupling inductance of the blocking circuit coupling are selected in such a way that the resultant resonance frequency is, as required, either below or above the band-pass pass range.

The invention claimed is:

1. A high frequency filter for a duplex filter comprising:

a plurality of electromagnetically coupled coaxial resonators, wherein the high frequency filter displays transmission behavior with a coupling impedance resonance having at least one blocking point at a frequency ($f_s$), the at least one blocking point at the frequency ($f_s$) being adjustable by presetting and/or preselecting a defined capacitive and inductive coupling between two of said plurality of coaxial resonators, one immediately following the other on a signal path, wherein the defined capacitive and inductive coupling are selected in such a way that the at least one blocking point is at said frequency ($f_s$) which is no further than ±50% from a center frequency defined by a high frequency filter passband.

2. The high frequency filter as claimed in claim 1, wherein the high frequency filter comprises at least two band-pass filters; and at least one pair, associated with each said band-pass filter, of adjacent ones of said plurality of coaxial resonators, one immediately following the other in the signal path, having a blocking circuit coupling at the frequency ($f_s$) in such a way that the at least one blocking point is located outside the pass range of the respective band-pass filter, the at least one blocking point being located in a pass range of the respective other band-pass filter.

3. The high frequency filter as claimed in claim 2, wherein the at least two band-pass filters are part of the duplex filter.

4. The high frequency filter as claimed in claim 2, wherein the at least one blocking point is located, viewed from the center frequencies of the band-pass filters, no further than five times a duplex center frequency separation of the at least two band-pass filters of said duplex filter.

5. The high frequency filter as claimed in claim 1, further comprising two internal conductors having therebetween, in an upper free end region thereof, an electrically conductive bridge member which shortens a free stretch between the two internal conductors and is set apart from respective internal conductors or internal conductor extensions formed at these locations, thus allowing a presettable total distance, consisting of two clearances between the bridge member and the adjoining internal conductors or said associated internal conductor extensions, to be preset, as a result of which the capacitive coupling can be adjusted.

6. The high frequency filter as claimed in claim 1, wherein from an opposing side of a housing of at least one of the plurality of coaxial resonators, a coupling pin protrudes between said two coaxial resonators into an interior of the resonator for varied adjustment of coupling capacitance.

7. The high frequency filter as claimed in claim 1, wherein the inductive coupling between two adjacent ones of said plurality of coaxial resonators can be preset and/or varied by presetting a distance between a position of internal conductors and/or an internal conductor extending transversely from a housing base or a housing cover.

8. The high frequency filter as claimed in claim 1, wherein the inductive coupling between the two adjacent ones of said plurality of coaxial resonators can be preset and/or varied by coupling pins which are positioned on the same side of a housing as internal conductors on a housing.

9. The high frequency filter as claimed in claim 1, wherein the inductive coupling between two adjacent ones of said plurality of coaxial resonators can be preset and/or varied by a coupling web which extends between two internal conductors at a partial height compared to the internal conductors and is preferably positioned on a same housing wall on which the internal conductors are electrically and mechanically bound and held.

10. The high frequency filter as claimed in claim 1, wherein the inductive coupling between two adjacent ones of said plurality of coaxial resonators can be preset and/or varied by at least one coupling loop arranged between two internal conductors of said two adjacent ones of said plurality of coaxial resonators, the coupling loop being bendable and/or rotatable for varying coupling inductance.

11. A high frequency filter, for a duplex filter comprising:

a plurality of electromagnetically coupled coaxial resonators, wherein the high frequency filter displays transmission behavior with a coupling impedance resonance having at least one blocking point at a frequency ($f_s$), the at least one blocking point at the frequency ($f_s$) being adjustable by presetting and/or preselecting a defined capacitive and inductive coupling between two of said plurality of coaxial resonators, one immediately following the other on a signal path, wherein said plurality of electromagnetically coupled coaxial resonators include n cross-coupled coaxial resonators cross-coupled to one another on the signal path, more than one and less than n−1 blocking circuit couplings being provided.

12. A high frequency filter for a duplex filter comprising:

a plurality of electromagnetically coupled coaxial resonators, wherein the high frequency filter displays transmission behavior with a coupling impedance resonance having at least one blocking point at a frequency ($f_s$), the at least one blocking point at the frequency ($f_s$) being adjustable by presetting and/or preselecting a defined capacitive and inductive coupling between two of said plurality of coaxial resonators, one immediately following the other on a signal path, wherein a plurality of pairs of said plurality of coaxial resonators, one immediately following the other on said signal path, are provided with defined frequencies ($f_{s1}$, $f_{s2}$, $f_{s3}$, . . . ), thus generating a plurality of defined blocking circuit couplings.

13. The high frequency filter as claimed in claim 12, wherein the capacitive and the inductive coupling can be preset in such a way that the at least one blocking point frequency ($f_s$) of the associated blocking circuit coupling has a lower frequency or a higher frequency than the high frequency filter.

14. A high frequency filter for a duplex filter comprising:

a plurality of electromagnetically coupled coaxial resonators, wherein the high frequency filter displays transmission behavior with a coupling impedance resonance having at least one blocking point at a frequency ($f_s$), the at least one blocking point at the frequency ($f_s$) being adjustable by presetting and/or preselecting a defined capacitive and inductive coupling between two of said plurality of coaxial resonators, one immediately following the other on a signal path, wherein a degree of capacitive cross-coupling between two adjacent internal conductors of two adjacent ones of said plurality of coaxial resonators can be preset by a radially protruding internal conductor extension toward each said adjacent internal conductor and thus by corresponding presetting of a clearance between said two adjacent internal conductors.

15. The high frequency filter as claimed in claim 14, wherein the internal conductor extension is formed transversely and preferably perpendicularly to an axial extent of the associated internal conductor in an upper end region of the internal conductor.

16. The high frequency filter as claimed in claim 15, wherein one of said adjacent internal conductors is cross-coupled to a preceding and subsequent one of said plurality of coaxial resonators in the signal path, thus generating two blocking circuit couplings, for which purpose the associated internal conductor is provided, in a direction of both preceding and subsequent ones of said adjacent cross-coupled coaxial resonators, with said internal conductor extension.

17. The high frequency filter as claimed in claim 16, wherein the associated internal conductor forms a T with the internal conductor extension.

18. The high frequency filter as claimed in claim 14, wherein at least one of the internal conductors is formed with a said radially protruding internal conductor extension in the manner of an inverted L.

19. A high frequency filter for a duplex filter comprising:

a plurality of electromagnetically coupled coaxial resonators, wherein the high frequency filter displays transmission behavior with a coupling impedance resonance having at least one blocking point at a frequency ($f_s$), the at least one blocking point at the frequency ($f_s$) being adjustable by presetting and/or preselecting a defined capacitive and inductive coupling between two of said plurality of coaxial resonators, one immediately following the other on a signal path, wherein the inductive coupling between two adjacent ones of said plurality of coaxial resonators can be preset and/or varied by a differing size of a coupling window or a coupling aperture between the two adjacent ones of said plurality of coaxial resonators.

20. A high frequency filter for a duplex filter comprising:

a plurality of electromagnetically coupled coaxial resonators, wherein the high frequency filter displays transmission behavior with a coupling impedance resonance having at least one blocking point at a frequency ($f_s$), the at least one blocking point at the frequency ($f_s$) being adjustable by presetting and/or preselecting a defined capacitive and inductive coupling between two of said plurality of coaxial resonators, one immediately following the other on a signal path, wherein the high frequency filter comprises, in addition to one or more blocking circuit couplings, one or more capacitive cross-couplings.

* * * * *